US005199553A

United States Patent [19]

Shinohara et al.

[11] Patent Number: 5,199,553

[45] Date of Patent: Apr. 6, 1993

[54] SLIDING CONTACTOR FOR ELECTRIC EQUIPMENT

[75] Inventors: Hisaji Shinohara; Naoshi Uchida; Kiyoshi Kandatsu, all of Kanagawa; Soujun Matsumura; Tadashi Chiba, both of Osaka; Shigeharu Miyazaki, Tokyo, all of Japan

[73] Assignee: Fuji Electric Co., Ltd., Kanagawa, Japan

[21] Appl. No.: 772,084

[22] Filed: Oct. 8, 1991

Related U.S. Application Data

[63] Continuation-in-part of Ser. No. 652,635, Feb. 8, 1991, abandoned.

[30] Foreign Application Priority Data

Oct. 9, 1990 [JP] Japan ..... 2-271498

[51] Int. Cl.[5] ..... H01H 1/02

[52] U.S. Cl. ..... 200/265; 200/267; 200/270; 428/929; 205/109; 29/885

[58] Field of Search ..... 200/262, 265, 266, 267, 200/270; 252/503, 506, 507, 508, 509, 510, 511, 514; 205/109, 263; 29/874, 885; 428/929, 614

[56] References Cited

U.S. PATENT DOCUMENTS

| | | | |
|---|---|---|---|
| 1,986,224 | 3/1930 | Sanders | 428/565 |
| 3,290,472 | 12/1966 | Savage | 200/262 |
| 4,622,269 | 11/1986 | Leung et al. | 200/268 X |
| 4,733,033 | 3/1988 | Morris et al. | 200/267 X |
| 4,904,317 | 2/1990 | Kang et al. | 200/266 |
| 4,976,828 | 12/1990 | Morin | 205/138 X |

FOREIGN PATENT DOCUMENTS

| | | |
|---|---|---|
| 875491 | 10/1981 | U.S.S.R. . |
| 839044 | 4/1957 | United Kingdom . |
| 1182491 | 4/1967 | United Kingdom . |
| 1534429 | 8/1976 | United Kingdom . |
| 2154064 | 8/1985 | United Kingdom . |

OTHER PUBLICATIONS

Japanese Unexamined Patent Publication No. 49-119154; published Nov. 14, 1974.

Japanese Unexamined Patent Publication No. 49-120833; published Nov. 19, 1974.

Japanese Unexamined Patent Publication No. 57-85999, published May 28, 1982.

WPI Abstract of JP 2 153 076, Jun. 12, 1990.

*Primary Examiner*—Henry J. Recla
*Assistant Examiner*—Glenn T. Barrett
*Attorney, Agent, or Firm*—Finnegan, Henderson, Farabow, Garrett & Dunner

[57] ABSTRACT

A movable electrical contactor having a surface thereof in slidable contact with a mating conductor, the surface being coated with a composite material in which particles of graphite (C) are dispersed in a matrix of silver (Ag). The coating film is formed by electric plating using a plating liquid of metal silver in the range of 2-100 g/l in concentration, potassium cyanide in the range of 2-250 g/l, potassium hydroxide in the range of 0.5-15 g/l, graphite powder in the range of 1-55 g/l, and a dispersant for dispersing graphite powder into plating liquid in the range of 10-2000 ppm.

2 Claims, 13 Drawing Sheets

POSITION RELATIONSHIP OF CURRENT LIMIT PIN FOR CURRENT LIMIT LATCH

SLIDING CONTACTOR FOR ELECTRIC EQUIPMENT

This application is a continuation-in-part of U.S. application Ser. No. 07/652,635, filed Feb. 8, 1991, in the name(s) of Jun Oyama, Naoshi Unchida, Makoto Unuma, Tatsunori Takahaski, Hisaji Shinohara, Kiyoshi Kandatsu and Kouji Asakawa now abandoned.

BACKGROUND OF THE INVENTION

This invention relates to relatively small circuit breakers such as wiring circuit breakers and earth leakage breakers, and more particularly to the structure of such a circuit breaker which electrically connects a movable contactor, which is operated by a drive unit, to a connecting conductor secured to a casing.

FIGS. 16 and 17 shows one example of a conventional three-pole type circuit breaker (wiring circuit breaker). More specifically, FIGS. 16 and 17 are sectional diagrams taken along its central pole, showing a closed state and a open state thereof, respectively.

In FIG. 16, reference numeral 1 designates a resin-molded casing; 2, a cover; 3, a stationary contactor which is integral with a power-source-side terminal 3*a*, the contactor 3 being secured to the casing 1 with screws (not shown); 4, a stationary contact provided on the stationary contactor 2; 5, a movable contactor swingably mounted through a shaft 7 on a resin-molded holder 6; 8, a movable contact provided on the movable contactor 5 in such a manner as to confront with the stationary contact 4; 9, an overcurrent tripping device comprising a bimetallic member 9*a*, a L-shaped stationary conductor 9*b* welded to the bimetallic member 9*a*, a stationary magnet 9*c* surrounding the bimetallic member 9*a*, and an armature 9*d* confronted with the stationary magnet 9*c* in such a manner that it is swingable; 10, a connecting conductor piled on the stationary conductor 9*b* and secured to the casing 1 with a screw 11; 12, a flexible conductor both ends of which are connected to the movable contactor 5 and the connecting conductor 10 by blazing; 13, a load-side terminal secured to the casing 1 with a screw 14; and 15, a flexible conductor which is connected between the bimetallic member 9*a* and the terminal 13.

Further in FIG. 16, reference numeral 16 designates a switching mechanism for swinging the movable contactor 5 together with the holder 6. The switching mechanism 16 is normally latched by a tripping mechanism 18 including a cross bar 17 extended over the poles. A handle lever 19 is rockably supported in such a manner that it is swingable right and left. More specifically, the handle lever 19 is coupled through a switching spring 20 to the switching mechanism 16, and has a handle 21 at the top. A contact spring 22 is connected between the holder 6 and the movable contactor 5 so as to urge the movable contactor 5 towards the stationary contactor 3.

The movable contactors of the right and left poles (not shown) are provided on the right and left of the movable contactor 5. These movable contactors are also rotatably mounted through shafts on holders similar to that 6 shown in FIG. 16. Those holders of the three poles are coupled to one another through a switching shaft, which is rotatably fitted in bearing grooves formed in inter-phase partition walls of the casing 1. Further in FIG. 16, reference numeral 23 designates an arc extinguishing chamber provided over the range of movement of the movable contact 8.

In the circuit breaker thus constructed, current is allowed to flow from the stationary contactor 3 through the stationary contact 4, the movable contact 8, the movable contactor 5, the flexible conductor 12, the connecting conductor 10, the stationary conductor 9*b*, the bimetallic member 9*a* and the flexible conductor 15 to the terminal 13. If, in this case, overcurrent about ten times as large as the rated current flows in the circuit breaker, then the bimetallic member 9*a* is curved to the left in FIG. 16, thus pushing the cross bar 17. As a result, the switching mechanism 16 is released from the tripping mechanism, so that the movable contactor 5 is swung together with the holder 6 by the elastic force of the switching spring 20, thus quickly leaving from the stationary contactor 3. In this operation, arcs are formed between the stationary contact 4 and the movable contact 8; however, they are drawn into the arc extinguishing chamber 13 by the electromagnetic force induced.

In the case where large current such as short-circuit current flows in the circuit breaker, the stationary magnet 9*c* will attract the armature 9*d*. Therefore, in this case, the cross bar 17 is struck before the bimetallic member 9*b* is curved, thus causing the movable contactor to disengage from the stationary contactor 3 instantaneously. When the circuit breaker is opened by turning the operating handle 21 to the right as shown in FIG. 17, with the switching mechanism 16 latched the movable contactor 5 is raised by the elastic force of the switching spring 20, thus leaving from the stationary contactor as shown.

In the conventional circuit breaker described above, the movable contactor 5 swung by the switching mechanism 16 is electrically connected through the flexible conductor 12 to the connecting conductor 10 secured to the casing 1. The flexible conductor 12 is, in general, formed by weaving a number of bundles of thin copper wires. However, the use of the flexible conductor in the circuit breaker suffers from the following difficulties:

(1) As the movable contactor 5 is swung, the flexible conductor 12 is also swung. To increase the movement of the flexible conductor 12 would increase the swing of the flexible conductor 12, so that the flexible conductor 12 might be broken by an accumulation of a metal fatigue.

(2) In order to prevent the breakage of the flexible wire 12, the latter should not be greatly deformed when swung. For this purpose, it is essential to provide a space large enough to accommodate it. However, in this case, the rated current is necessarily increased, and the flexible conductor 12 must be increased in diameter accordingly. As a result, the casing 1 must be increased in size; that is, it is difficult to miniaturize the circuit breaker.

(3) The movable contactor 5 is resisted by the flexible conductor 12 when swung for a switching operation. The resistance given by the flexible conductor depends on the condition of connection of the flexible conductor with the mating parts and on the frequency of switching of the circuit breaker, thus affecting the contact pressure of the contacts 4 and 8 and the speed of movement of the movable contactor 5.

In addition, the present invention further relates to slidable contacts for connecting electric conductors in various electric equipment, such as circuit breakers or the like. More particularly, the invention concerns an improved surface treatment of such slidable contacts.

In electric equipment such as- circuit breakers, a disconnecting contact, a load switch, a connector, or the like, having a mechanically movable electric conductive portion, slidable contacts are used between movable and fixed conductor portions.

In the region of relative conductor movement, contacting conductive surfaces are momentarily changed during relative sliding movement so that contact resistance becomes unstable and tends to be high during relative surface movement by comparison with that in a stationary state. As a result of the increased contact resistance, the contacting surface portions are heated by electrical energy. If the contacting surfaces are made of copper or a copper alloy, surface oxidation occurs, the contact resistance is made higher by oxidation which, in turn, promotes further oxidation until the conductive surfaces no longer function as such. Conventionally, therefore, in devices designed to handle large current flow, the sliding contact surfaces are plated with silver (Ag) to prevent or at least reduce the oxidation.

Ag-plating, however, is so soft that it is subject to galling, and is worn away even under no-load switching to expose the foundation conductor. Further, Ag is softened by electrical heat during current conduction, leading to increased galling, and possible separation of the plating layer. Moreover, under high current loads, the contacting surface portions can be fused by heat generation. Although the heat generation can be suppressed to a certain extent by increasing the contact force of the sliding contact surfaces, movement of the slidable contact surfaces becomes more difficult with increased contact force, thus requiring increased sizes of drive mechanisms and spring mechanisms for increasing the contact force. Further, as the contact force is increased, the frictional force between the sliding conductive surfaces increases and results in abrasion of the plating layer irrespective of current loads.

To cope with the foregoing phenomenon, conductive grease has been applied to an Ag-plating coating film of the sliding contacts. Although intended to prevent galling and to stabilize contact resistance, experiments conducted by the present inventors have demonstrated that the use of such grease increased contact resistance during sliding of the contact surfaces, and that when a large current load is incurred, the Ag-plating film coated with grease tended to fuse more than the same contacts not coated with grease. Further, the grease has a tendency to become hardened after use for a long time at a high temperature.

SUMMARY OF THE INVENTION

In view of the foregoing, it is an object of this invention to provide a circuit breaker in which the movable contactor is electrically connected to the stationary-side connecting conductor without use of the flexible conductor, whereby the above-described difficulties accompanying a conventional circuit breaker are eliminated.

Another object of the invention is to provide a circuit breaker in which the above-described electrical connection is obtained more positively.

A further object of the invention is to provide a circuit breaker in which the movable contact can be readily mounted on the holder.

A still further object of the invention is to provide a circuit breaker in which the electrically connected parts are lengthened in service life.

The foregoing objects of the invention have been achieved by the provision of a circuit breaker in which a movable contactor is held by a holder of electrically insulating material which is rotatably supported through a switching shaft on a casing, and the movable contactor is driven by a switching mechanism to be swung about the switching shaft together with the holder to perform a switching operation; in which, according to the invention, the movable contactor is slidably electrically connected to a connecting conductor secured to the casing, CHARACTERIZED by further comprising a flexible lead wire forming a parallel circuit for the slidably electrically connection between said movable contactor and said connecting conductor.

In order to allow the movable contactor to slidably electrically connect to the connecting conductor, according to the invention, the connecting conductor has a pair of arms at the connecting end through which the connecting conductor is electrically connected to the movable contactor, in such a manner that the movable contactor is located between the arms, and a pair of springs are disposed on both sides of the arms so as to push the arms against the side walls of the movable contactor.

In this connection, the arms of the connecting conductor have portions near the contact surfaces of the arms with the movable contactor in such a manner that the portions are confronted with each other and the distance therebetween is smaller than that between the contact surfaces, so that the electromagnetic force inducted therein is utilized more effectively to increase the contact pressure therebetween.

The movable contactor is mounted to a mounting member with engaging pieces formed by cutting a thin plate, and the mounting member is then press-fitted in a holder with a recess which has engaging steps in correspondence to the engaging pieces. This will facilitate the assembling of the circuit breaker.

The contact surfaces are heated by the frictional heat generated when slid or by the Joule heat produced when current passes through them. If the contact surfaces are of ordinary electrical conductive material such as copper or copper alloy, then they will be readily oxidized by the heating, as a result of which the contact resistance is increased; that is, the current capacity is decreased. In order to prevent the oxidation of the contact surfaces thereby to maintain the current capacity of the latter unchanged, the following method is generally employed: the slide contact surfaces are plated with silver (Ag).

However, the inventors have found it through experiments that, when a no-load switching operation (in which the contact surfaces are slid with no current) is repeatedly carried out, then the silver layers on the contact surfaces are worn to expose the ground metal, copper, and when large current is interrupted (with current flowing through the contact surfaces), the silver layers are molten to expose the copper.

In order to eliminate this difficulty, in the invention the slide contact surfaces of at least one of the movable contactor and connecting conductor are plated with a silver and carbon compound material.

In the circuit breaker of the invention, the movable contactor and the connecting conductor are in slide contact with each other so that they are electrically connected to each other. Therefore, it is unnecessary to provide the flexible conductor, so that it is unnecessary to provide a space for the flexible conductor in the casing. In this case, the brake torque applied through the connecting conductor to the movable contactor when the latter performs a switching operation (i.e., when the movable contactor swings about the coupling shaft of the holders) is the product of the frictional force at the contact surfaces and the average radius of rotation of small contact areas. Therefore, the effect of the brake torque is less on the contact pressure and switching speed of the movable contact which is provided at the end of the movable contactor which is much longer than the average radius of rotation. In addition, the above-described frictional force is maintained substantially unchanged until the slide contact surfaces are galled or welded.

In the circuit breaker of the invention, the movable contactor and the connecting conductor are connected by the lead wire so as to form a parallel circuit for the slide contact region. When large current such as short-circuit current flows in the circuit breaker, this current is divided between the slide contact region and the lead wire so as to decrease a thermal load of the slide contact regions. Accordingly, it is possible to increase a current capacity of the circuit breaker in response to the reduction of the thermal load to be subjected to the slide contact region.

In the circuit breaker of the invention, the connecting conductor has a pair of arms formed at the connecting end through which the connecting conductor is electrically connected to the movable contactor in such a manner that the arms are confronted with each other and the movable contactor is held between the arms. In this case, the contact area is twice as large as that in the case where only one side of the movable contactor is in contact with the connecting conductor. Furthermore, the electromagnetic attractive force induced between the currents which flow in the two arms in the same direction acts to push the arms against the movable contactor more effectively. If, in this case, the arms of the connecting conductor are allows to have inwardly curved portions in the vicinity of the contact surfaces of the arms with the movable contactor in such a manner that the distance between the inwardly curved portion is smaller than that between the contact surfaces, then the above-described electromagnetic attractive force is more effectively utilized to increase the contact pressure. The contact pressure can be maintained more positively by providing compression springs both sides of the arms to push the latter against the movable contactor.

The movable contactor is held by the holder as follows: First the movable contactor is secured to a mounting member with engaging pieces which are formed by cutting a thin plate, and then the mounting member is press-fitted in a holder with a recess which has engaging steps in correspondence to the engaging pieces. In this case, the movable contactor can be combined with the holder in one action, which facilitates the assembling of the circuit breaker.

The inventors have considered about the exposure of the ground metal, copper, as follows: The reason why the silver layer is worn to expose the ground metal, copper, when the no-load switching operation is repeatedly carried out with the movable contactor in slide contact with the connecting conductor is that the silver layers formed on the movable contactor and the connecting conductor are galled. In addition, the reason why the copper layer is exposed when large current is interrupted is that the silver layers on the movable contactor and the connecting conductor are welded to each other. When, in the latter case, the welded part or parts are broken while being slid, the contact surfaces become rough and accordingly unsatisfactory in electrical contact, as a result of which they are further heated by the current to a higher temperature, thus becoming more liable to be molten or welded.

This difficulty can be eliminated by forming films on the slide contact surfaces by using a compound material which is prepared by dispersing carbon (C) particles in a silver matrix. As is well known in the art, carbon is excellent in lubricity, but is not welded to with silver at all. Hence, the silver-carbon compound material can prevent the occurrence of galling when the no-load switching operation is carried out repeatedly. Furthermore, at the interruption of large current, the layers formed on the contact surfaces with the compound material may be molten, but they will not be welded to each other. Thus, in both cases, the slide contact surfaces are kept smooth, and are sufficient current capacity accordingly.

In addition, the present invention further has been made in view of the above circumstances and has as an object to provide a sliding contact in which the contact resistance is so low that stable current conduction can be obtained even during sliding movement of the contacts.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims To achieve the objects and in accordance with the purpose of the invention, as embodied and broadly described herein, the movable electric contactor of this invention comprises a contactor having a surface thereof in slidable contact with a mating conductor, the surface being coated with a composite material in which particles of graphite (C) are dispersed in a matrix of silver (Ag) and characterized in that the coating film is formed by electric plating using a plating liquid comprising metal silver in the range of 2–100 g/l in concentration, potassium cyanide in the range of 2–250 g/l, potassium hydroxide in the range of 0.5–15 g/l, graphite powder in the range of 1–55 g/l, and a dispersant for dispersing graphite powder into plating liquid in the range of 10–2000 ppm.

BRIEF DESCRIPTION OF THE DRAWINGS

The present invention will be apparent from the following detailed description taken in conjunction with the accompanying drawings in which.

DETAILED DESCRIPTION OF THE EMBODIMENTS

Figure 1:
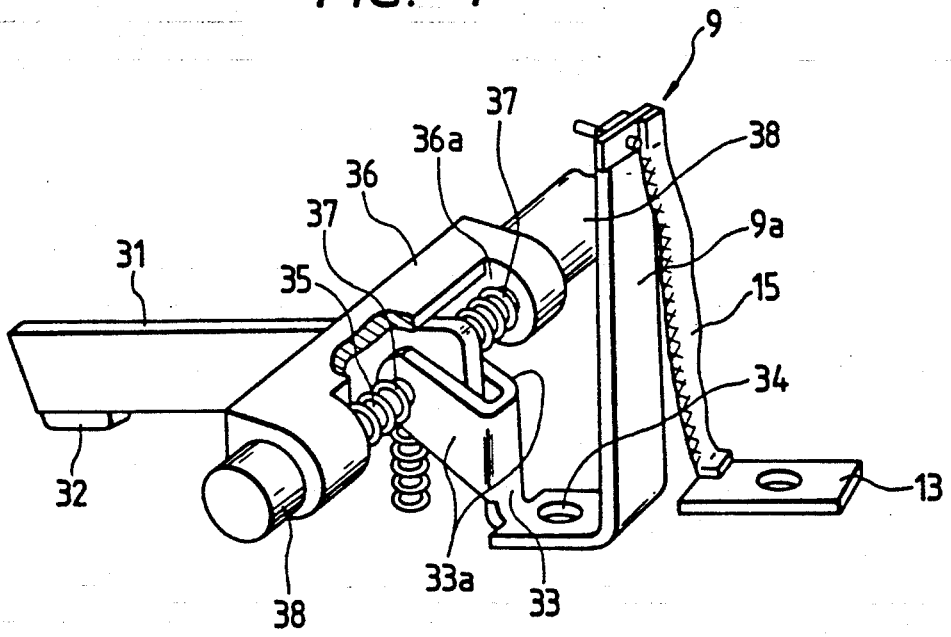
FIG. 1 is a perspective view showing a movable contactor and its relevant components in a first embodiment of this invention.

Preferred embodiments of this invention will be described with reference to FIGS. 1 through 15. In these figures, those components which have been described with reference to FIG. 16 showing the conventional circuit breaker are therefore designated by the same reference numerals or characters.

FIG. 1 is a diagram for a description of the principle of the invention; more specifically a perspective view showing the movable contactor of the central pole in a first embodiment of the invention. The movable contactor 31 is formed by blanking a copper plate, and has a movable contact 32 welded to its one end by blazing. A connecting conductor 33 is integral with the bimetallic member 9*a* and has a through-hole 34, into which a screw (not shown) is inserted to secure the connecting conductor 33 to the casing 1. In this case, it is unnecessary to provide the conductor 9*b* (shown in FIG. 16) for fixing the bimetallic member 9*a*. The connecting conductor 33 has a pair of arms 33*a* on both sides which are confronted with each other. The arms 33*a* elastically hold the end portion of the movable contactor 31; in other words, the arms are in slide contact with the movable contactor 31. The movable contactor 31 and the arms 33*a* have through-holes (not shown) in alignment with one another into which a shaft 35 is inserted as shown in FIG. 1.

A recess 36*a* for receiving the movable contactor 36 is formed in a resin-molded holder 36. Both ends of the shaft 35 is fitted in the side walls of the recess 36*a*, respectively. More specifically, coil springs, or compression springs, 37 are mounted on the shaft 35 on both sides of the arms 33*a* so that the inner walls of the arms 33*a* are pushed against the side walls of the movable contactor 31. The holder 36 is coupled through switching shafts 38 integral with it to the holders of the right and left poles. The holders are rotatably mounted on the casing 1 through the switching shafts 38. When driven by the switching mechanism 16, the movable contactor 31 is swung about the coupling shaft 38, and at the same time the other right and left movable contactors (not shown), which are supported by the holders (not shown), are also swung about the coupling shaft 38.

Figure 2:
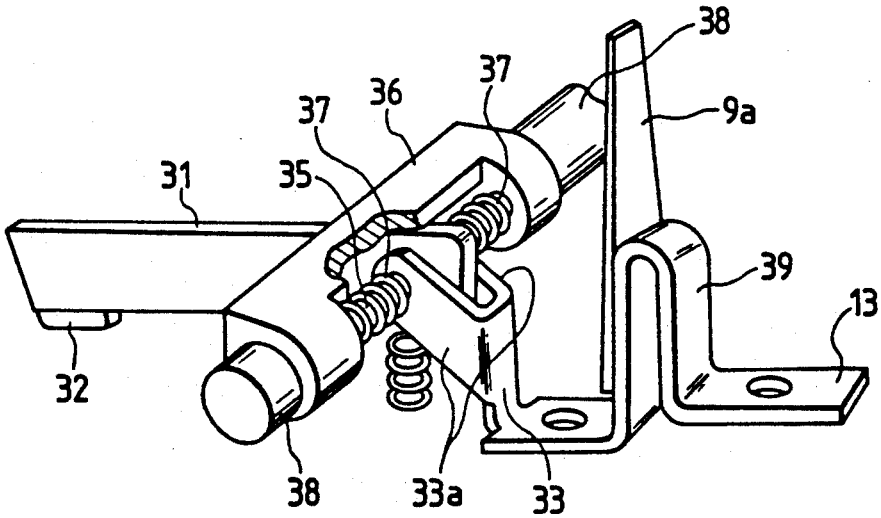
FIG. 2 is a perspective view showing a movable contactor and its relevant components in a second embodiment of the invention.
Figure 16:
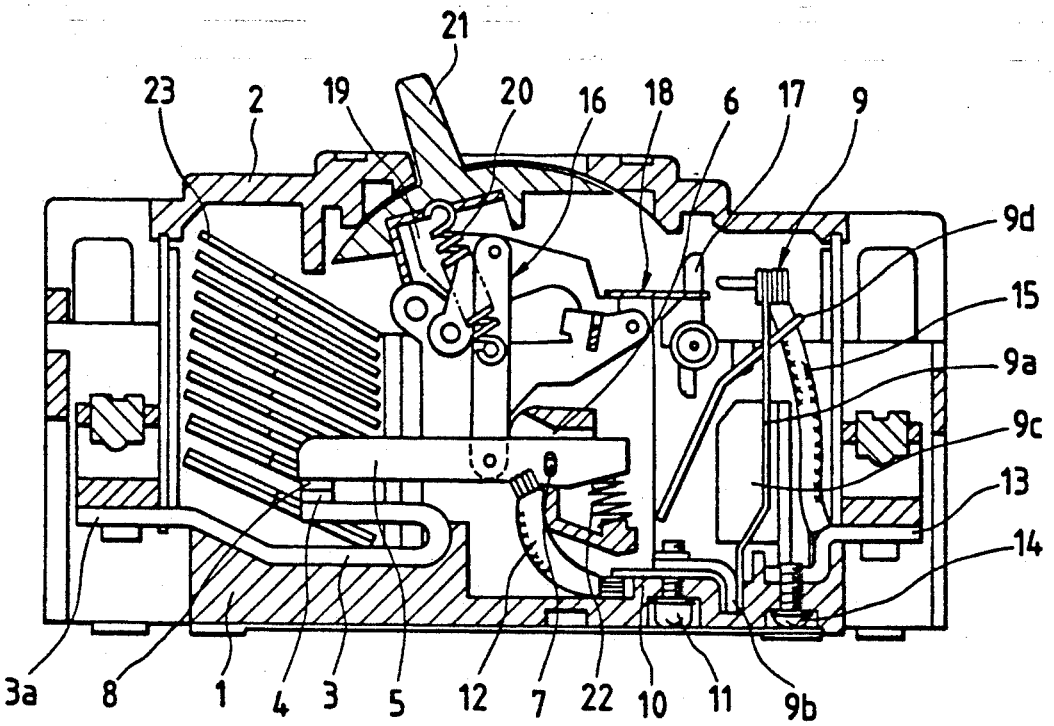
FIG. 16 PRIOR ART
FIG. 16 is a vertical sectional view showing the central pole of a conventional circuit breaker in which central pole is closed.
Figure 17:
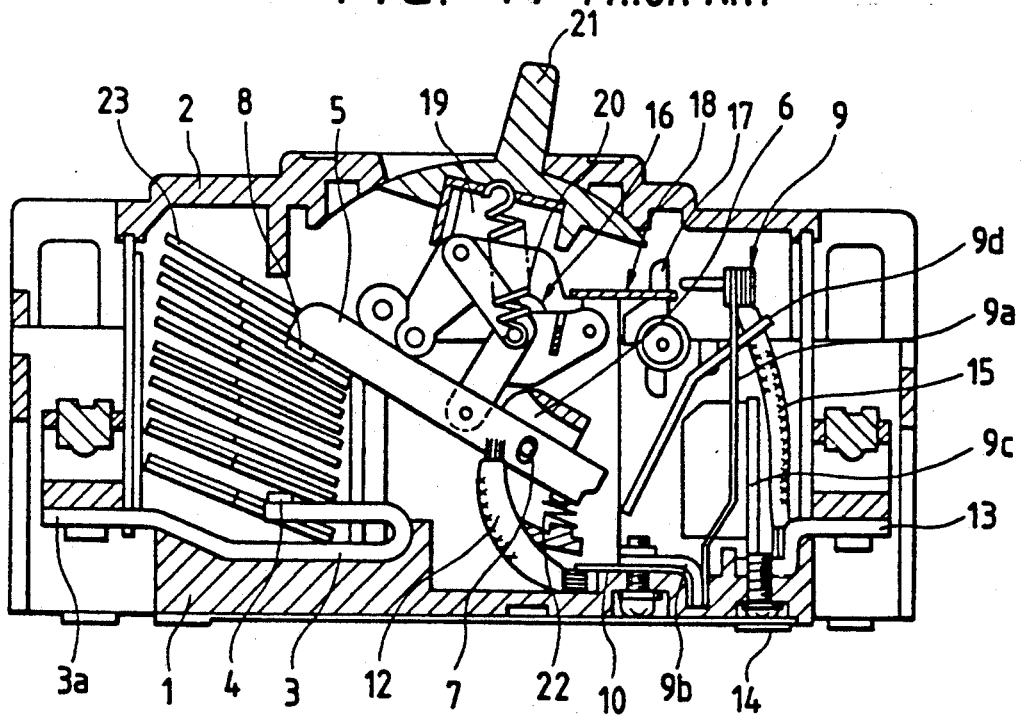
FIG. 17 PRIOR ART
FIG. 17 is a vertical sectional view showing the central pole which is open.

The overcurrent tripping devices 9 in the conventional circuit breaker shown in FIG. 16 and the circuit breaker of the invention shown in FIG. 1 are of the directly heated type that current is applied to the bimetallic member 9*a* itself. However, there is available an overcurrent tripping device of indirectly heated type in which current is applied to a heater conductor so that the heat generated thereby is transmitted to the bimetallic member coupled to it. FIG. 2 shows a circuit breaker using such an overcurrent tripping device, a second embodiment of the invention. The second embodiment is the same as the first embodiment shown in FIG. 1 except that the connecting conductor 33 is integral with a heater conductor 39.

Figure 3:
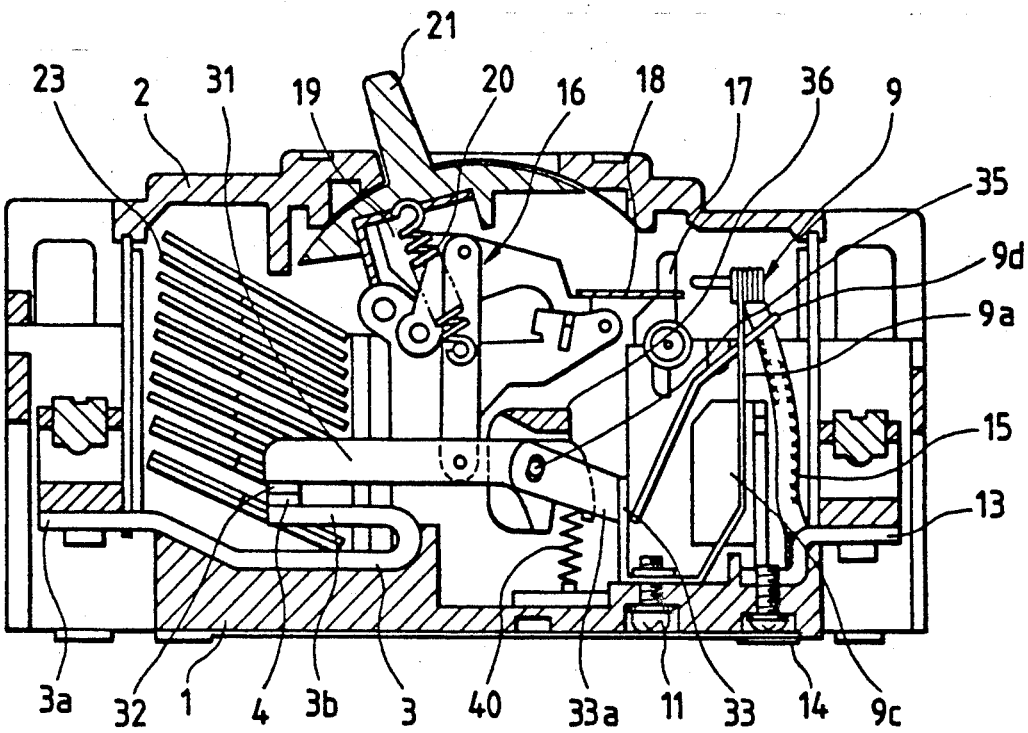
FIG. 3 is a vertical sectional view showing the central pole of a circuit breaker equipped with the movable contactor and its relevant components shown in FIG. 1, which central pole is closed.
Figure 4:
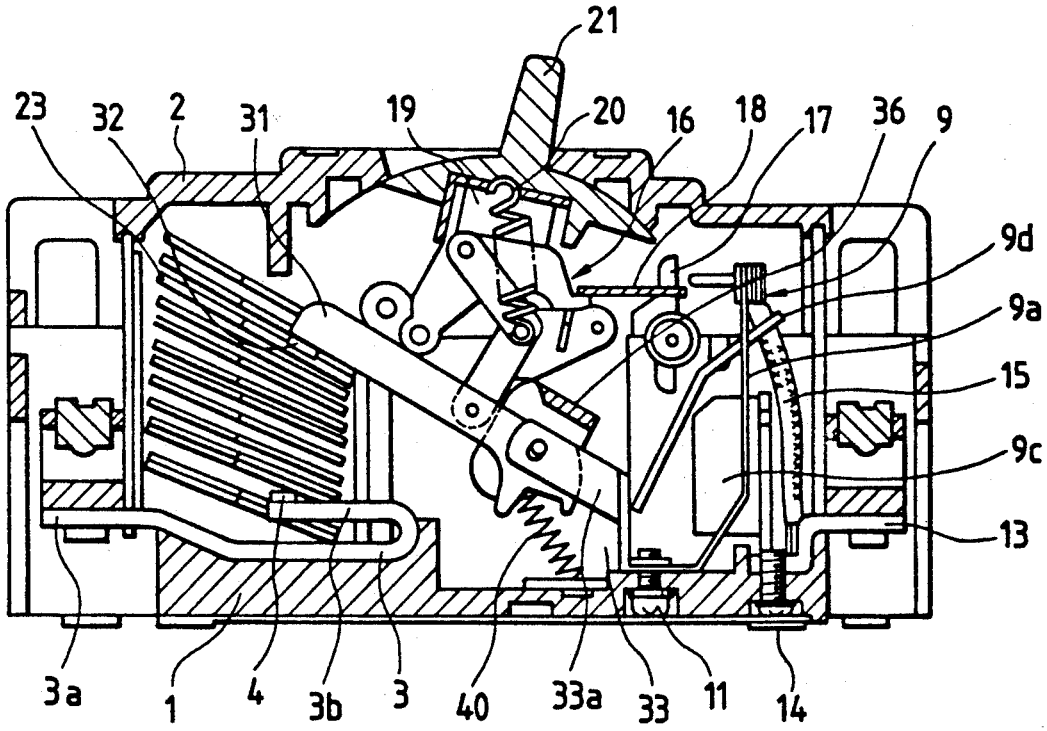
FIG. 4 is a vertical sectional view showing the central pole which is open.

FIGS. 3 and 4 are sectional diagrams showing the circuit breaker having the movable contactor 31 and the connecting conductor 33 shown in FIG. 1. In FIG. 3, the circuit breaker is closed; and in FIG. 4, it is open. In the circuit breaker, the current flowing from the stationary contactor 3 through the stationary contact 4, the movable -contact 8 to the movable contactor 31 is allowed to flow directly to the connecting conductor 33 because the side walls of the movable contactor 31 are in slide contact with the inner walls of the arms 33*a*, and then the current flows through the bimetallic member 9*a* and the flexible conductor 15 to the terminal 13. A contact spring 40 composed of a compression spring inserted between the case 1 and the movable contactor 31 is formed so as to urge the movable contactor 31 towards the stationary conductor 3. Thereby, a suitable contact pressure is applied to the movable contactor 31. The other construction and operation are the same as those in the conventional circuit breaker described above.

FIGS. 5 through 9 show a third embodiment of the invention, which is more practical than the first and second embodiments described above.

Figure 5A:
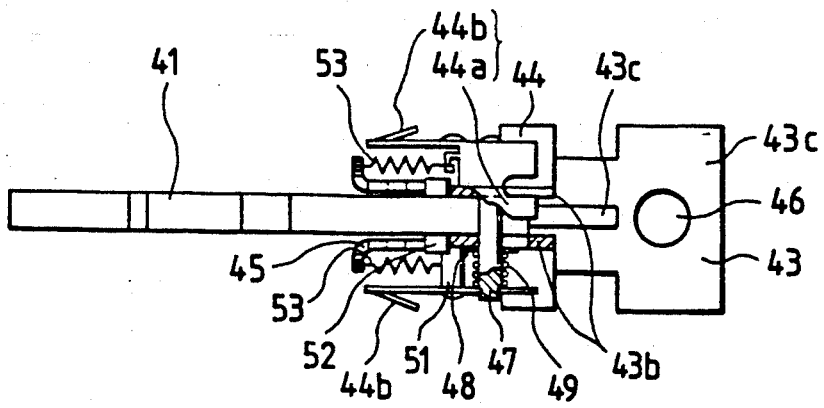
FIG. 5A, FIG. 5B and FIG. 5C are a plan view, a side view and a rear view showing a movable contactor and its relevant components in a third embodiment of the invention, respectively.
Figure 5B:
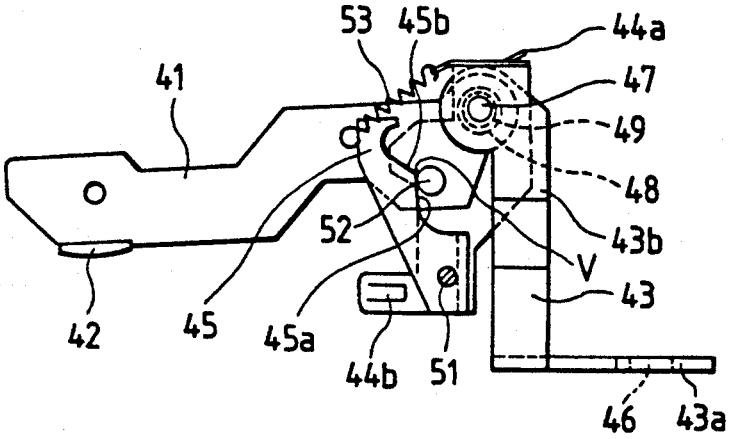
Figure 5C:
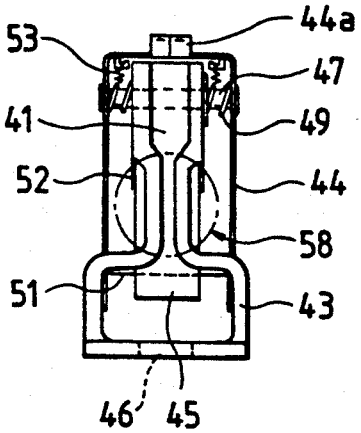

FIG. 5 shows a movable contactor and a connecting conductor kept in slide contact with it. More specifically, FIG. 5A, FIG. 5B and FIG. 5C are a plan view in which an upper portion of a copper plate 44 (which will be described later) is partially omitted, side view in which a side plate of the copper plate is partially omitted at the front side, and rear view, respectively, showing those components. In FIG. 5, reference character 41 designates the movable contactor formed by blanking a copper plate; 42, a movable contact welded to the end of the movable contactor 41 by brazing; 43, the connecting conductor formed by bending a copper plate; 44, a U-shaped mounting member formed by bending a thin elastic steel plate; and 45, a current limit latch made of steel plate, the current limit latch 45 forming a current limit mechanism.

The connecting conductor 43 has a base 43*a* with a through-hole 46 which is secured to the circuit breaker casing 1 with a screw inserted into the through-hole 46 formed, and a pair of arms 43*b* which are extended upwardly from the base 43*a* in such a manner as to confront with each other. The arms 43*b* are bent as shown in FIG. 5 to the extent that the distance therebetween is slightly smaller than the thickness of the movable contactor 41, so that they elastically hold the rear end portion of the movable contactor 41 which is forcibly inserted therebetween; that is, they are held in slide contact with the side walls of the movable contactor 41. In addition, as shown in FIG. 5A, the base portion 43*a* is formed with a slit 43*c* which is cut from a left end of the FIG. 5A to an adjacent portion of the through-hole 46 along a center line thereof in such a manner that the arms 43*b* is easily deformed in a lateral direction.

The movable contactor 41 and the arms 43*b* have through-holes in alignment with one another, into which a shaft 47 is relatively loosely inserted. Springs 49 and 49 composed of compression springs are mounted on the shaft 47 through washers 48 and 48 on both sides of the arms 43*b*, respectively. Then, the two ends of the shaft 47 are coupled to the side walls of the mounting member 44 by caulking for instance. Thus, the movable contactor 41 is swingable about the shaft 47, and the arms 43*b* are suitably pushed against the movable contactor 41.

Figure 9A:
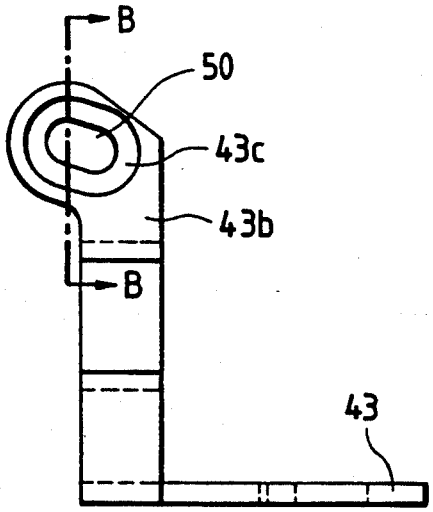
FIG. 9A is an enlarged side view showing a connecting conductor in FIG. 5.
Figure 9B:
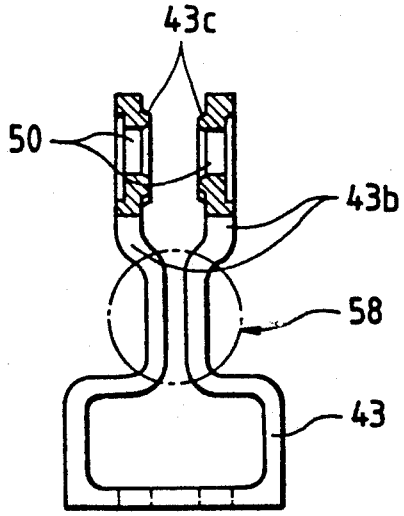
FIG. 9B is a sectional view taken along line B—B in FIG. 9A.

FIG. 9A is a side view of the connecting conductor 43, and FIG. 9B is a sectional view taken along line B-B in FIG. 9A. As shown in FIG. 9, annular protrusions 43*d* are formed around the through-holes 50 into which the shaft 47 is inserted, so that the annular protrusions are in contact with the movable contactor 41; that is, the contact area of the movable contactor 41 with the arms 43*b* is limited to the small annular protrusions. Accordingly, the brake torque applied to the movable contactor 41 by the frictional force is small, and the contact pressure is improved. In addition, even in the case where the switching operation is repeatedly carried out, the movable contact and the arms are held stably in contact with each other, because the contact area is stable.

Referring back to FIG. 5, the current limit latch 45 is rotatably supported by the mounting member 44 through a shaft 51, the two ends of which are secured to the side walls of the mounting member similarly as in the Case of the above-described shaft 47. The current limit latch 45 is a fork-shaped hard component which is bent in the form of the character "U" near the shaft 51. The current limit latch 45 has a normal surface 45*a* generally extending in a vertical direction, a current limit surface 45*b* extending in a counter-clockwise inclined direction with respect to the vertical direction, and a curve change point V interposed between the normal surface 45*a* and the current limit surface 45*b*, which are located on a side confronting to the shaft 47. In a normal switching operation, the normal surface 45*a* of the current limit latch 45 is engaged with a current limit pin 52 which is embedded in the movable contactor 41 in such a manner as to extend on both sides of the movable contactor 41. A pair of current limit spring 53 are connected between the upper end portion of the current limit latch and the upper end portion of the mounting member so as to push the current limit latch against the current limit pin 52 at all times. On the other hand, the movable contactor 41 is urged by the current limit spring 53 through the current limit pin 52 to turn about the shaft 47 in a counter-clockwise direction in FIG. 5B in such a manner that the movable contactor 41 is subjected to a rotation moment (torque). When the circuit breaker is assembled (which will be described later), a contact pressure between the movable contactor 42 and the stationary contactor 4 is obtained due to the fact that the movable contactor 41 is subjected to the rotation moment (torque). That is, the current limit spring 53 has functions of a contact spring.

The mounting member 44 has engaging pieces 44*a* and 44*b* which are formed by cutting its top plate and side plates, respectively, The assembly of the movable contactor 41 and the connecting conductor 43 is secured to the holder with the engaging pieces 44*a* and 44*b*. The holder will be described in more detail.

Figure 6:
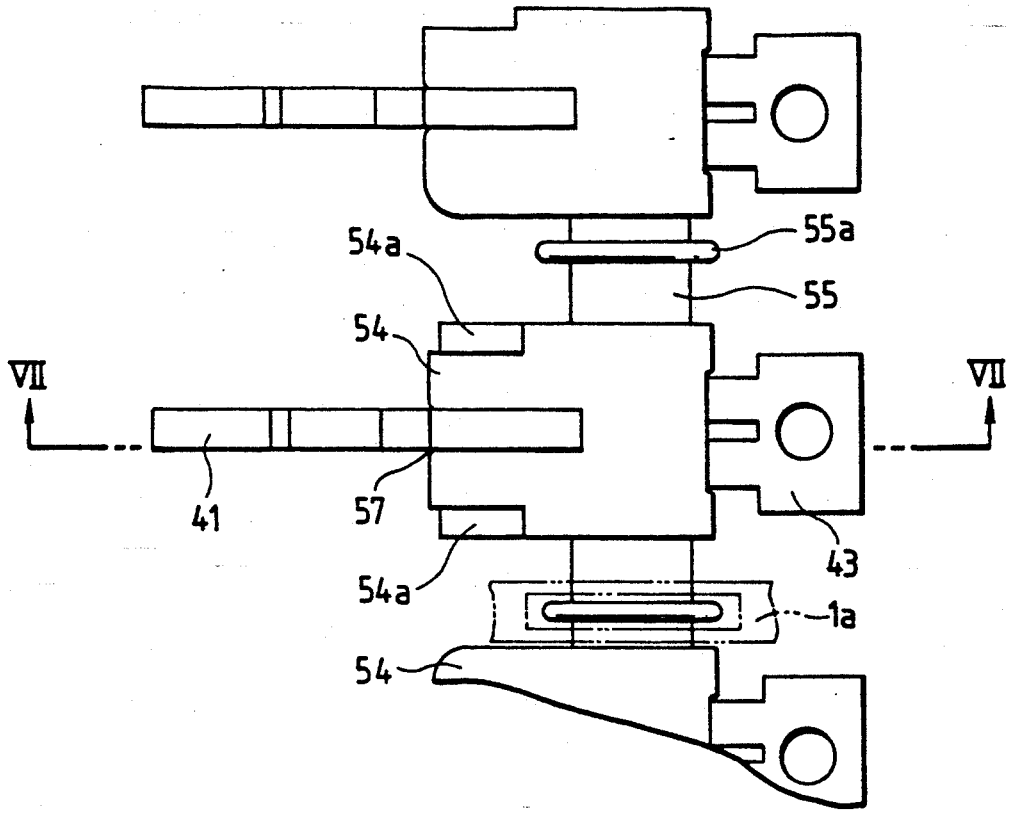
FIG. 6 is a plan view showing essential components of a holder holding the movable contactor shown in FIG. 5.
Figure 7:
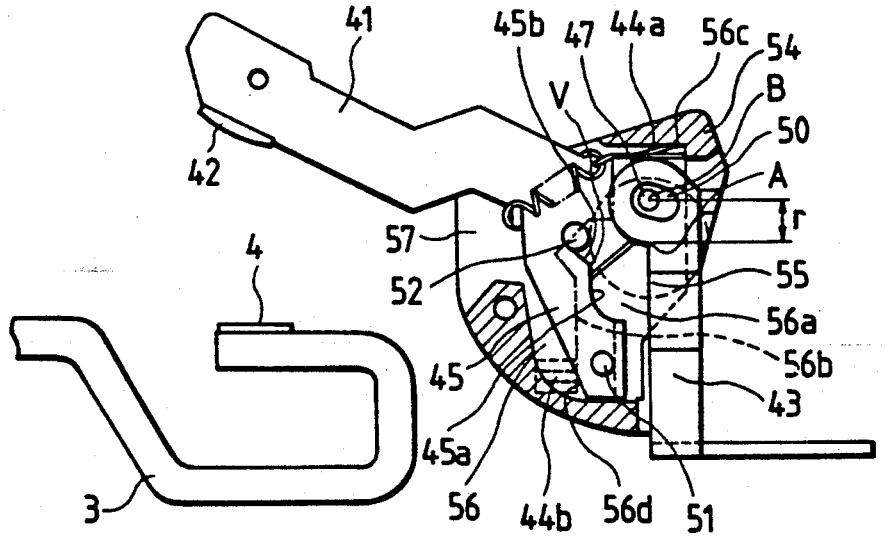
FIG. 7 is a sectional view taken along line VII—VII in FIG. 6.

FIG. 6 is a plan view showing the holder of the central pole, and FIG. 7 is a sectional view taken along line VII—VII in FIG. 7. As shown in FIG. 6, the holders 54 of the three poles are connected to one another through the switching shaft 55. Inter-phase barriers 55*a* are formed integral with the switching shaft 55. The holders 54 are rotatably supported with the coupling shaft 55 is fitted in the bearing grooves (not shown) of the inter-phase partition walls la (indicated by the two-dot chain line) of the casing 1. Notches 54*a* are formed at both side walls of the holder 54 of the central pole to connect rinks of an open-close structure.

The assembly shown in FIG. 5 is mounted to the holder 54 as indicated in FIG. 7. A recess 56 is formed in the holder 54 so as to permit the insertion of the assembly into the holder from behind, and a window 57 is formed in the front wall of the holder. The movable contactor 41 is inserted into the window 57 in such a manner that it is swingable for switching operation. Fitting surfaces 56*a* are formed in the right and left walls of the recess 56 in correspondence to the width of the mounting member 44. The front edges 56*b* of the fitting surfaces 56*a* are made similar to the contour of the front wall of the mounting member 44. A step 56*c* is formed in the top wall of the recess 56 in correspondence to the engaging pieces 44*a*. In addition, steps 56*d* are formed in the right and left walls of the recess in such a manner that they are extended surface.

Figure 8:
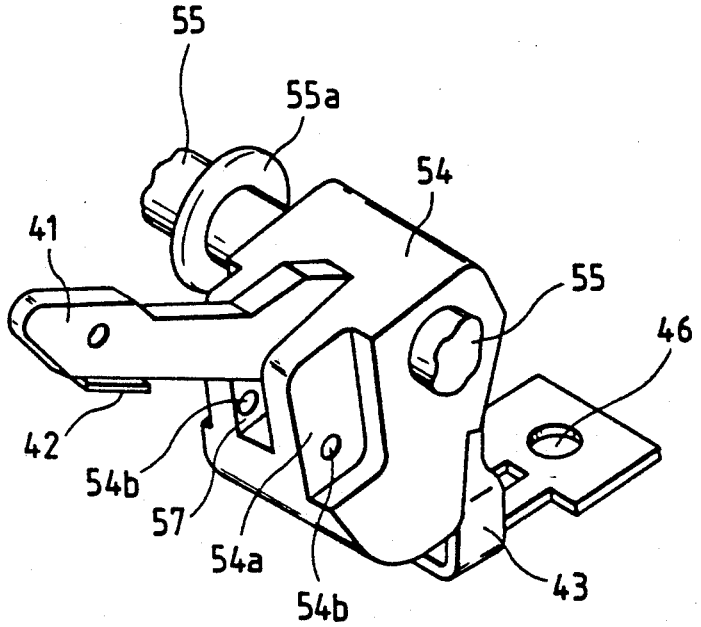
FIG. 8 is a perspective view showing the assembly of the holder in FIG. 6 and the movable contactor in FIG. 5.

The assembly shown in FIG. 5 is pushed into the holder with the engaging pieces 4*a* and 44*b* of the mounting member 44 elastically deformed inwardly until the front wall of the mounting member 44 abuts against the fitting surface front edges 56*b* of the right and left walls. In this operation, the engaging pieces 44*a* and 44*b*, being restored by the elastic forces thereof, are engaged with the steps 56*c* and 56*d*, respectively, thus being fixed as indicated in FIG. 7. FIG. 8 is a perspective view showing the holder 54 with the movable contactor 41 fixed in the above-described manner. However, through holes 54*b* are provided to insert pins for connecting rinks of the open-close structure.

Figure 12A:
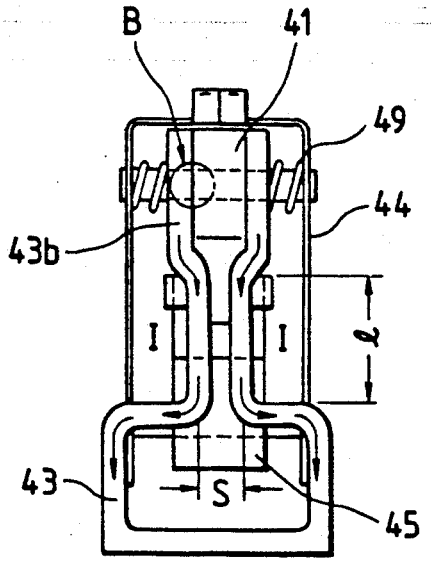
FIG. 12A is a rear view showing the movable contactor and the connecting conductor illustrated in FIG. 5C.
Figure 12B:
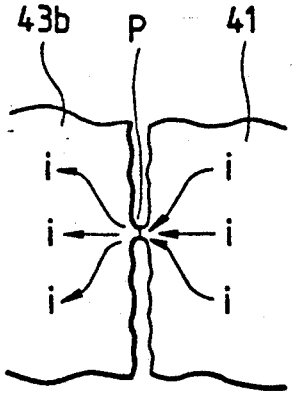
FIG. 12B is an enlarged diagram showing a portion B of FIG. 12A.
Figure 13:
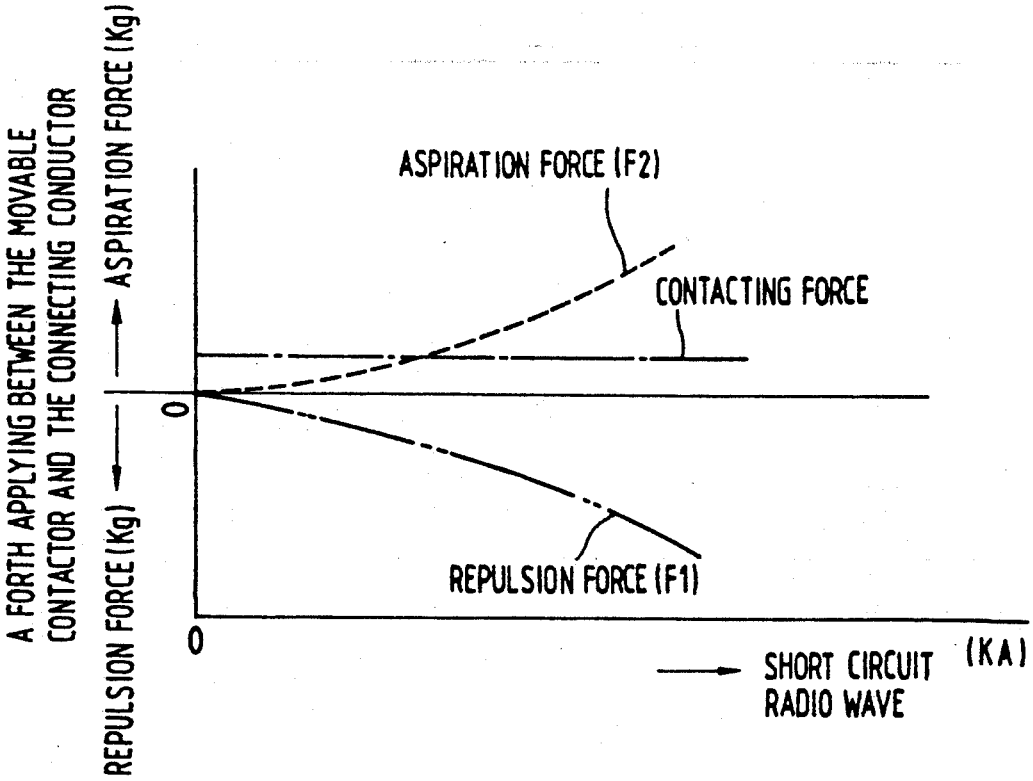
FIG. 13 is a graphical representation indication the variations of an electromagnetic repulsive force and an electromagnetic attractive force with a short-circuit current at a contact portion in FIG. 12.
Figure 14:
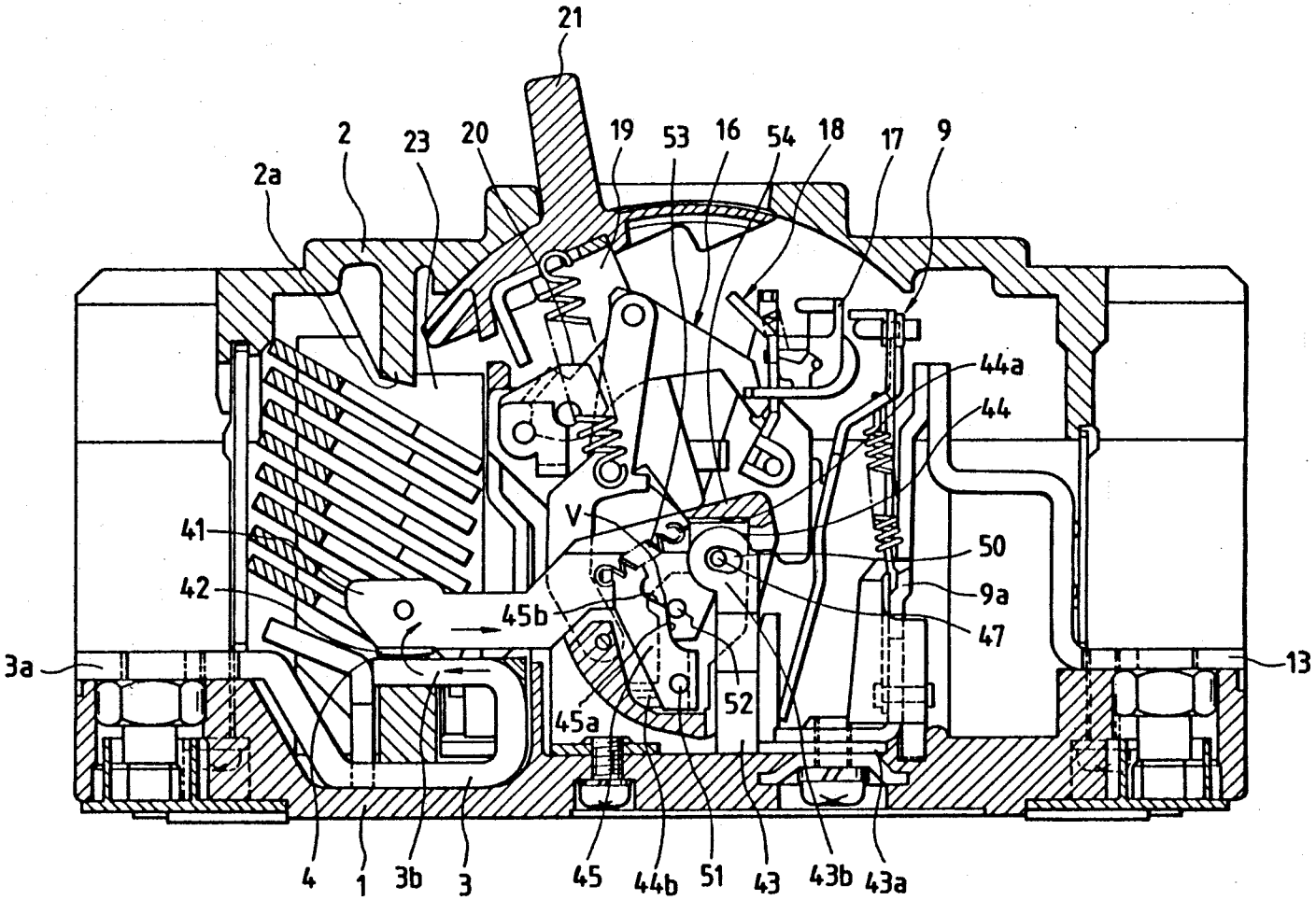
FIG. 14 is a sectional view showing a central pole of a circuit breaker having a movable contactor in FIG. 5 in which the pole is closed.

FIG. 14 is a vertical sectional view showing the central pole of the circuit breaker, which is closed, in which the holder 54 holding the assembly in FIG. 5 is assembled. The base 43 a of the connecting conductor 43 and the bimetallic member 9*a* are overlapped and secured to the case 1. Under a condition as shown in FIG. 12, the connecting conductor 41 is pressure-pushed toward the stationary contactor 3, so that the connecting conductor 41 is slightly rotated to turn about the shaft 47 in clockwise direction. In response to this movement, the current limit latch 45 is rotated through the current limit pin 52 against the current limit spring 53 so as to turn about the shaft 51. As a result, a contact pressure between the contacts 4 and 42 is obtained due to the fact that the movable contactor 41 is subjected to a rotation moment (torque) from the current limit spring 53 in the counter-clockwise direction in the FIG. 14.

The holder 54 and the movable contactor 41 built in the circuit breaker are rotatable about the central axis A (FIG. 7) of the coupling shaft 55; however, the central axis B of the shaft 47 is shifted a distance r from the central axis A of the coupling shaft 55, and therefore the shaft 47 is turned about the axis A with the radius r. In order to allow the shaft 47 to turn in this manner, the through-holes 50, into which the shaft 47 is inserted, are elongated as shown in FIG. 9A. As described above, the central axis B of the shaft 47 is shifted a distance r from the central axis A of the coupling shaft 55, so that the movable contactor 41 is slightly moved forward and backward (left and right direction in FIG. 14). Accordingly, the contacts 4 and 42 are slidably moved so as to eliminate an oxidation of the contact surfaces thereof.

A current limit interruption by the action of the current limit latch 45 will be described in brief. As shown in FIG. 14, the stationary contactor 3 includes a conductor portion 3*b* which is in parallel with the conductor of the movable contactor 5. When current flows in the conductor portion 3*b* and the movable contactor 31 through the contacts 4 and 42, the current in the conductor portion 3*b* and that in the movable contactor 31 are different in direction, thus inducing an electromotive repulsive force therebetween. As a result, the movable contactor 31 is kept urged to move away from the stationary contactor.

When large current such as short-circuit current flows in the circuit breaker with the movable contactor 41 shown in FIG. 5B, the movable contactor 41 is greatly driven, so that it, going over the current limit latch 45 against the elastic force of the current limit springs 53, is swung clockwise about the shaft 47, thus causing the current limit pin 52 to ride on the wall 45*b* (FIG. 7) of the current limit latch 45. As a result, the current limit pin 52 slides on the normal surface 45*a* of the current limit latch 45, passes over the curve change point V, and rides on the current limit surface 45*b*.

In the current limit latch 45, the angle between the normal surface 45*a* and the current limit surface 45*b* is so determined that, when the pin 52 is in contact with the surface 45*a*, the force induced by the elastic force of the current limit spring 53 to act on the current limit pin 52 from the current limit latch 45 turns the movable contactor 41 counterclockwise in the figure, and when the pin 52 rides on the current limit surface 45*b*, the force acts to turn the movable contactor 41 clockwise. Hence, when the movable contactor 41 is swung more than the predetermined switching distance to move over the curve change point V, both the above-described electromagnetic repulsive force and the swinging force by the current limit spring 53 are applied to the movable contactor 41, so that the movable contactor is quickly moved away from the stationary contactor before done by the switching mechanism 16. Accordingly, the arc voltage is abruptly increased, so that the so-called "current limit interruption" is carried out.

FIG. 7 indicates the result of the current limit interruption thus carried out. The current limit latch 45 is reset as follows: In the tripping operation of the switching mechanism 16 which is carried out in succession with the above-described current limit operation in response to an instruction from the over-current tripping device 9, with the movable contactor 41 held abutted against the stopper 2*a* formed integral with the cover 1 the holder 54 is forcibly turn clockwise in FIG. 14, to reset the current limit latch 45. In this case, the current limit pin 52 is moved over the curve change point V in the opposite direction to engage with the normal surface 45*a*.

Figure 10A:
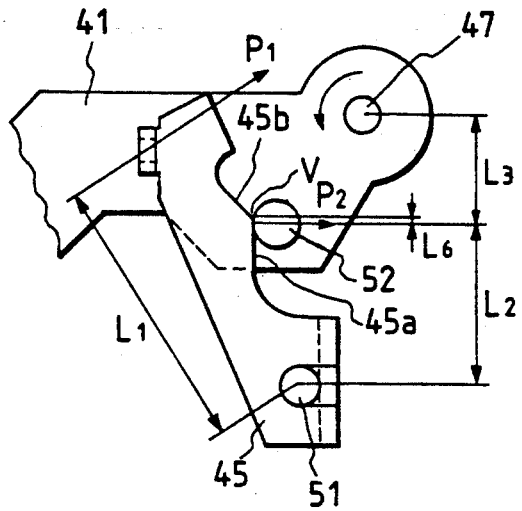
FIG. 10A is an explanatory diagrams showing the relationships between the force of the current limit latch and the force of the current limit pin acting during the current limit operation.
Figure 10B:
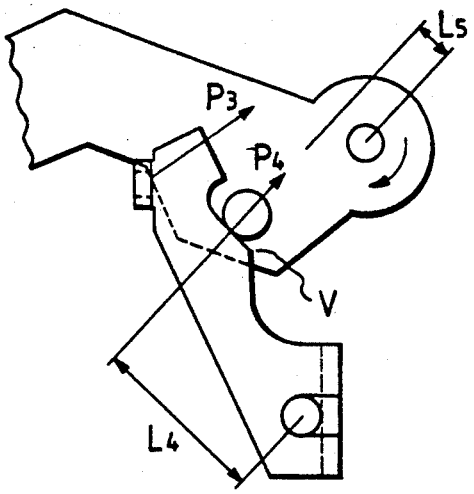
FIG. 10B is an explanatory diagrams showing the relationships between the force of the current limit latch and the force of the current limit pin when the circuit breaker has just opened.
Figure 11:
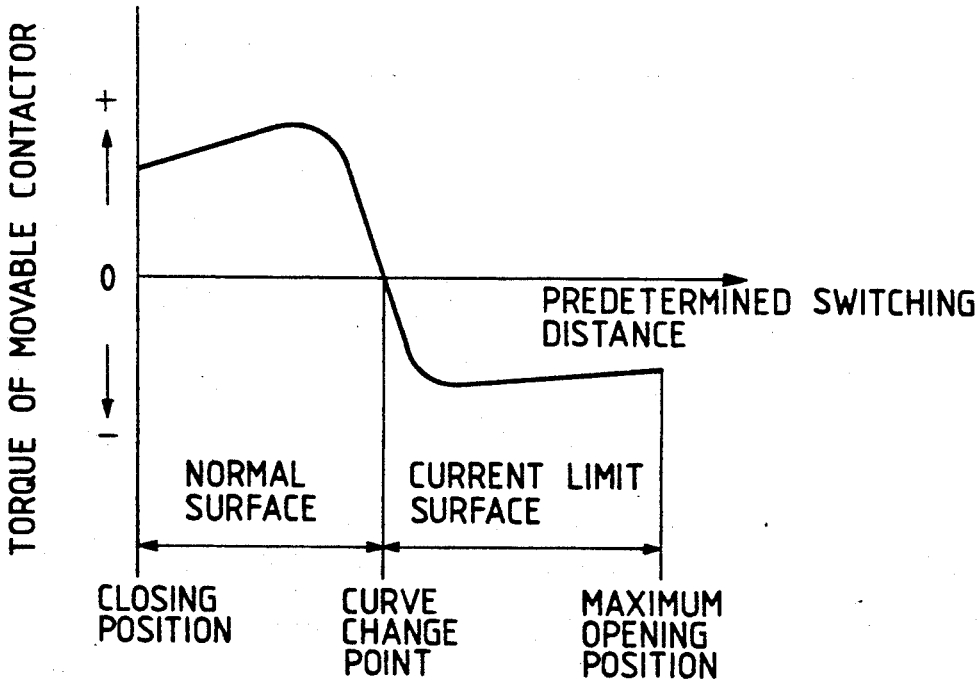
FIG. 11 is an explanatory diagrams showing the relationships between the torque which is subjected to the movable contactor induced by the current limit spring and the predetermined switching distance of the movable contactor.

The parts (A) and (B) of FIG. 10 are explanatory diagrams showing the relationships between the forces acting during the above-described current limit operation. More specifically, the part (A) of FIG. 10 shows the circuit breaker which is closed, and the part (B) shows the circuit breaker which has just opened. FIG. 11 is a graphical representation indicating the torque applied to the movable contactor according to the elastic force of the current limit spring 53 with the distance of movement of the movable contactor 41 in the current limit operation.

In the part (A) of FIG. 10 showing the closed circuit breaker, a torque $P_1 \times L_1$ (where $O_1$ is the elastic force of the current limit spring 53, and $L_1$ is the distance from the pin 51) is applied to the current limit latch 45. The torque applies a force $P_2$ to the current limit pin 52 which is on the substantially vertically held normal surface 45*a* and at a distance $L_2$ from the pin 51 ($P_1 \times L_1 = P_2 \times L_2$). The force $P_2$ applies a torque $P_2 \times L_3$ to the movable contactor to turn the latter counterclockwise (where $L_3$ is the distance between the current limit pin 51 and the shaft 47). This torque provides a contact pressure between the movable contact 41 and the stationary contact 4.

In the case of the part (B) of FIG. 10 in which the pin has moved over the curve change point V to the current limit surface, the torque acting on the current limit latch by the spring force $P_3$ provided by the current limit spring 53 applies a force $P_4$ to the current limit pin 52 which is on the current limit surface and at a distance $L_4$ from the pin 51. This force $P_4$ is extended above the shaft 47 because of the angle of inclination of the current limit surface 45*b*, thus applying a torque $P_4 \times L_5$ (where $L_5$ is the distance from the shaft 47) to the movable contactor 41 to turn the latter clockwise; i.e., to move the movable contactor 41 away from the stationary contactor.

FIG. 11 shows the reversal of the direction of the torque acting on the movable contactor 41 which is caused immediately when the current limit pin 52 sliding on the normal surface 45*a* is moved over the curve change point V by the electromagnetic repulsive force. The positive (+) side of the torque is for the counterclockwise direction, and the negative (−) side is for the clockwise direction. In the case where large current flows to cause the electromagnetic repulsive force to exceed the contact pressure, it is desirable that the above-described reversal of the direction of the torque is caused quickly. For this purpose, it is necessary to suppress the increase in the positive (+) direction of the torque during the period of time that the current limit pin 52 is moved from the closing position to the curve change point V, and to minimize the amount of engagement $L_6$ of the current limit pin 51 and the current limit latch 45.

The increase in the positive (+) direction of the torque can be suppressed by decreasing the angular difference between the normal surface 45*a* and the current limit surface 45*b*. However, it should be noted that if the angular difference is decreased, then the direction of the force $P_2$ is shifted towards the shaft 47, and accordingly the distance $L_3$ is decreased, so that the contact pressure is decreased. If the amount of engagement $L_2$ is decreased to an excessively small value, then the current limit pin 52 may go over the curve change point V by the contact bounce caused when the circuit breaker is closed. Therefore, with these facts taken into account, the angle of the normal surface 45*a* and the amount of engagement $L_6$ are set to suitable values, respectively.

If, in the case of the circuit breaker in which the movable contact is moved away from the stationary contact by the electromagnetic repulsive force, the contact spring is merely deformed, then as the movable contact is moved away from the stationary contact, the reaction of the contact spring is increased, thus obstructing the movement of the movable contactor. On the other hand, the current limit mechanism illustrated is greatly effective in current limitation. With the current limit mechanism, it has been confirmed that for instance in interruption of a current of AC 460V, 42 kA, the passed current peak is about 26 kA; that is, the current peak is greatly reduced when compared with about 33 kA in the prior art.

The part (A) of FIG. 12 shows essential portions of the movable contactor 41 and the connecting conductor 43 which is in slide contact with the latter, and the part (B) is an enlarged view showing a portion indicated at B in the part (A). As shown in FIG. 12, current flows through several points P in the contact region, and after passing through the contact point P, it diverges. That is, the current flowing before passing through the contact point P is different in direction from that flowing after passing through the contact point P. Therefore, an electromagnetic repulsive force acts between the movable contactor 41 and the arms 43*b* of the connecting conductor 43.

The magnitude $F_1$ of the electromagnetic repulsive force is as follows:

$$F_1 = \Sigma 5\ I_j^2 \times 10^{-2}\ (kg)\ (j = 1 \text{ through } n)$$

where $I_k$(kA) is the current passing through a contact point P, and n is the number of contact points P.

The electromagnetic repulsive force $F_1$ is abruptly increased as the current passing through the circuit breaker increases and accordingly the current passing through each contact point P increased. As a result, the elastic force of the springs 49 is reduced, so that the number of contact points P is decreased accordingly, whereby the current passing through the remaining contact points P becomes excessively large. Thus, arcing or welding may occur at the remaining contact points.

Accordingly, in the case where the movable contactor 41 is in slide contact with the connecting conductor 43, the applicable short-circuit current rating is limited to a certain value. The limit value may be increased by increasing the elastic force of the springs 49. However, this method will suffer from a difficulty that the movable contactor 41 is normally moved at low speed due to the fact that a friction force is increased. This difficulty may be eliminated by the following method: As shown in FIG. 5C and FIG. 9B, the arms 43*b* have portions 58 near the contact portions of the arms 43 with the movable contactor 41, which are so designed that the distance between the portions 58 is smaller than the distance between the contact portions. The action of the portions 58 will be described with reference to FIG. 10A.

It is assumed that the portion 58 of the arms have a length of l, and are spaced by S from each other, and a current of I(kA) flows in each of the arm 43*b*. The currents I flowing in the arms 43*b* are the same in direction. Therefore, the following electromagnetic attractive force $F_2$ is inducted between the arms 43*b*:

$$F_2 = 2.04\ kl/S \cdot I^2 \text{ (where k is the constant)}$$

If the distance S is so determined that the electromagnetic attractive force $F_2$ is larger than the above-described electromagnetic repulsive force $F_1$, then the applicable short-circuit current rating can be increased with the elastic force of the springs 49 maintained unchanged. FIG. 11 is a graphical representation indicating the variations of the electromagnetic repulsive force $F_1$ and the electromagnetic attractive force $F_2$ with the short-circuit current passing through the circuit breaker. In addition, a contact force shown in FIG. 10A is directed to a force obtained by an elasticity of the spring 49 and the connecting conductor 43.

As shown in FIG. 9B, the annular protrusions 43*c* formed at the contact portions of the arms 43*b* serves as spacers to space the arms 43 from the movable contactor 41, thus increasing the distance between the currents flowing in the opposite directions before and after the contact region. As a result, the electromagnetic repulsive force $F_1$ is further decreased.

It is desirable that at least one of the slide contact surface of the movable contactor and the connecting conductor is plated with a compound of silver (Ag) and carbon (C), to prevent the difficulty that the contact surfaces are galled or welded when the circuit breaker is operated repeatedly under no load or when large current interruption is carried out, and to improve the electrical performance of the circuit breaker.

Experimental examples of the circuit breaker were manufactured in which the movable contactor 41 and the connecting conductor 43 as shown in FIG. 5 were plated as described above. The circuit breakers were manufactured and tested as follows:

Experimental Example 1—A film of Ag-6%C (% by volume) was formed on the movable contactor 41 and the connecting conductor 43 to a thickness of 7 μm by electroplating. In this case, the carbon particles dispersed in the silver particles were 0.5 to 2 μm in major diameter and 0.2 to 0.5 μm.

Experimental Example 2—Similarly, a film of Ag-3%C (% by volume) was formed on the movable contactor 41 and the connecting conductor 43 to a thickness of 7 μm by electroplating. In this case, the carbon particles dispersed in the silver particles were 0.8 to 5 μm in major diameter and 0.3 to 1 μm.

As for a comparison example, a film of Ag was formed on the movable contactor and the connecting conductor to a thickness of 7 μm by electroplating.

Those movable contactors and connecting conductors were used to form circuit breakers. And a no-load switching test and a large current interruption test were given to the circuit breakers thus provided, the results of which are as indicated in the following Table 1:

TABLE 1

| | Surface film | No-load switching test | Large current interruption test |
|---|---|---|---|
| Experimental example | Ag-6% C | No copper was exposed when a switching operation was performed 10,000 times | No copper was exposed with interruption of of 30 KA |
| Experimental example | Ag-3% C | No copper was exposed when a switching operation was performed 10,000 times | No copper was exposed with interruption of of 30 KA |
| Comparison example | Ag | Copper was exposed when a switching operation was performed 2,000 times | Copper was exposed with interruption of of 20 KA |

As is apparent from Table 1, in the case of the circuit breaker with the movable contactor and the connecting conductor plated with Ag-C compound material, when compared with the circuit breaker with those plated ordinarily, the copper is hardly exposed. Although the two experimental examples have been described, the percentage (%) and the grain size of C (carbon) are not limited to those indicated above because the effect of the invention depends on the properties of carbon. In addition, the damaging or welding of the slide contact portion depends on the area thereof and the surface pressure applied thereto. Hence, the area and the surface pressure is also taken into account to determine the percentage by volume and the grain size of carbon. However, it is not preferable to increase the percentage by volume and the grain size of carbon (C) to excessively large values, because although being electrically conductive, carbon (C) is several hundred or several thousand times as high in resistance as silver (Ag); that is, the relatively high resistance accelerates the generation of heat at the slide contact portion, thereby to increase the terminal temperature of the circuit breaker.

In the above-described experimental examples, the electroplating method was employed. However, the movable contactor and the connecting conductor may be plated by other methods, because what is important is that they are plated with Ag-C compound material.

The slide contact portion is prevented from being galled or welded by the layer of carbon formed on it. Therefore, substantially the same effect can be obtained by forming the Ag-C film on one of the movable contactor and connecting conductor. In this case, the other should be plated with silver (Ag); however, since carbon has an oxidation preventing effect, the silver plating may not be necessary; that is, it is satisfactory in electrical characteristic to some extent as it is. It is not always necessary to cover the movable contactor and the connecting conductor in their entirety with the film; that is, all that is necessary is to cover the slide surfaces with the film.

Figure 15A:
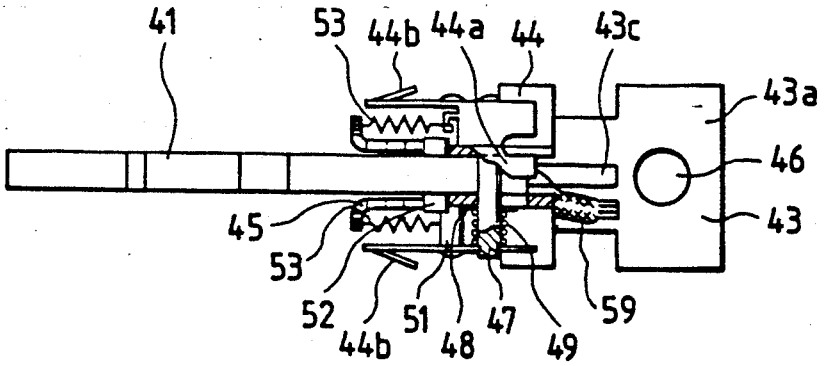
FIG. 15A, FIG. 15B and FIG. 15C are a plan view, a side view and a rear view showing a movable contactor and its relevant components in a fourth embodiment of the invention, respectively.
Figure 15B:
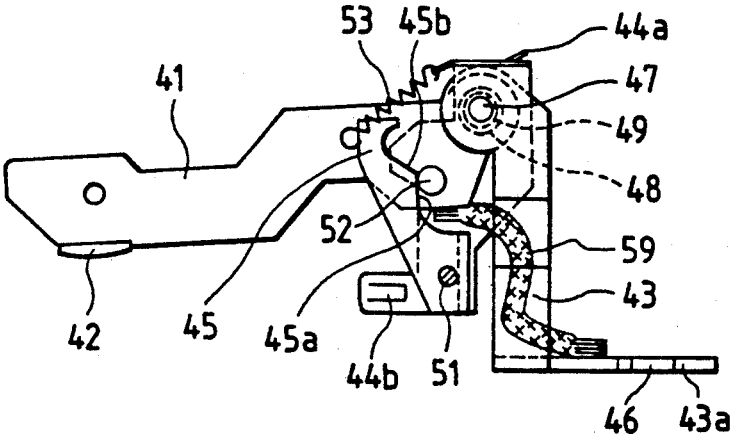
Figure 15C:
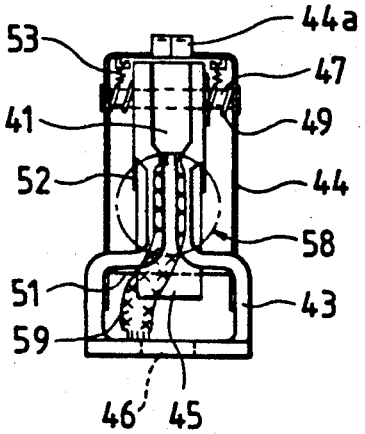

Furthermore, it is recommended to disperse the following hard particles as third particles in the Ag-C compound material, to increase the hardness of the film thereby to provide the slide contact portions which are hardly worn and long in service life accordingly: SiC, WC, ZrB, $Al_2O_3$, $ZrO_2$, $Cr_2O_3$, $TiO_2$, $R_2O_3$, $ThO_2$, $Y_2O_3$, $MoO_3$, $W_2C$, TiC, $B_4C$ and $CrB_2$ FIG. 15 shows a fourth embodiment of the invention in which the movable contactor is connected through a lead wire to the connecting conductor which is in slide contact with the movable contactor. More specifically, the part (A), (B) and (C) of FIG. 15 are a plan view, a side view, and a rear view of the movable contactor, respectively.

In FIG. 15, reference numeral 59 designates a lead wire whose resistance is substantially equal to that of the slide contact region of the movable contactor 41 and the connecting conductor 43. One end of the lead wire 59 is connected to the lower surface of the rear end portion of the movable contactor 41 by brazing, and the other end is connected to the base portion 43*a* of the connecting conductor 43 also by brazing; that is, the lead wire 59 is used to form a parallel circuit for the slide contact region.

The lead wire being connected in this manner, the current flowing between the movable contactor 41 and the connecting conductor 43 is substantially divided into two parts flowing the slide contact region and the lead wire 59. Hence, when large current such as short-circuit current flows, the thermal load of the slide contact region is reduced by half, and the limit current value of the whole circuit breaker can be increased as much.

As was described above, the movable contactor can be electrically connected to the connecting conductor without use of a flexible conductor according to the invention. Therefore, the circuit breaker high in reliability and excellent in interruption characteristic can be made smaller in size according to the invention. And the circuit breaker is made long in service life by plating the slide contact surfaces of the movable contactor and the connecting conductor with the silver and carbon compound material according to the invention. Further, it is possible to increase the current capacity of the circuit breaker in such manner that a part of the current of the slide contact region is divided with the lead wire.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

Figure 18A:
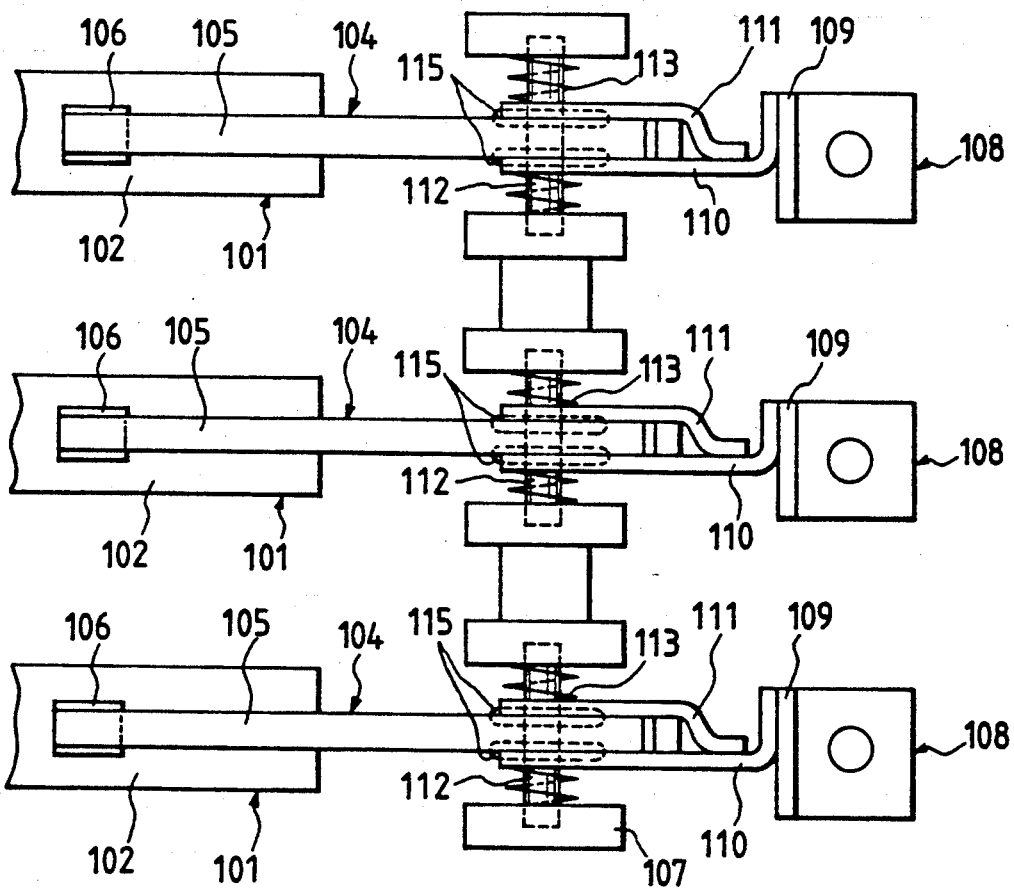
FIG. 18(A) is a plan view showing the movable contactor portion of a circuit breaker to which the present invention is applied.
Figure 18B:
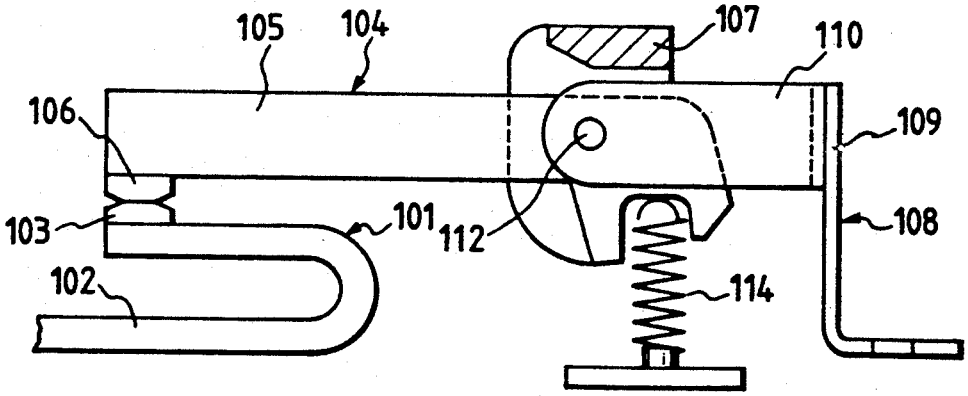
FIG. 18(B) is a side view of the same.

In FIGS. 18(A) and 18(B) of the drawings, a fifth embodiment of the present invention is shown in which the sliding contact surfaces thereof are incorporated in a power supply circuit breaker constituted by movable conductors in slidable contact with fixed conductors. In particular, the reference numeral 101 designates fixed contactors, each of which is constituted by a fixed conductor 102 made of a copper material and secured on a casing of the circuit breaker (not shown) by screws or other suitable connectors (not shown) and a contact 103 attached on the front end of the fixed conductor 102. The reference numeral 104 designates movable contactors, each of which is constituted by a movable conductor 105 made of a copper material and driven by a switching mechanism (not shown), so as to undergo pivotal movement for switching, and a contact 106 attached on the front end of the movable conductor 105. The reference numeral 107 designates holders of an insulating material for holding the respective movable contactors 104, and the reference numeral 108 designates fixed conductors connected to a heating body of an overcurrent tripping apparatus (not shown).

Each of the fixed conductors 108 is constituted by an L-shaped conductor 109 which is upright and fixed by a screw (not shown) on the casing. An L-shaped conductor 110 is horizontally coupled with the conductor 109, and an S-shaped conductor 111 is coupled with the conductor 110 in parallel with the latter. The conductors 110 and 111 define forked arms which make sliding contact with the movable conductor 105 sandwiched therebetween as shown in the drawing.

A support shaft 112 for rotating the movable conductor 105 is inserted through the movable conductor 105 and the conductors 110 and 111, and is held at its opposite ends by the holders 107. Compression springs 113 are inserted between the conductors 110 and 111 and the holders 107, respectively, to press the conductors 110 and 111 against the movable conductor 105. The reference numeral 114 designates a contacting spring inserted between the rear end of each movable conductor 105 and the casing so as to urge the movable conductor 105 counterclockwise in the drawing to generate contact pressure between the fixed and movable contacts 103 and 106.

In the conducting state illustrated, current flowing from the fixed contactor 101 into the movable contactor 104, flows into the fixed conductor 108 through the conductors 110 and 111 by way of sliding contact portions or regions represented in FIG. 18(A) by dashed line ovals 115. Such current then flows into a load side terminal plate through the overcurrent tripping apparatus (not shown). When an operating handle (not shown) is operated, or if the overcurrent tripping apparatus performs a tripping operation, the switching mechanism (not shown) operates so that the movable contactors 104 are rapidly pivoted to rotate clockwise, as shown in FIG. 18(B), with the respective support shafts 112 as fulcrums. During such movement, the movable conductor 105 and the conductors 110 and 111 are slid relative to each other in each of the sliding contact portions 115.

According to the present invention, at least one of the sliding contact surfaces in each the regions 115 is coated with a composite in which C is dispersed in an Ag matrix. Carbon has superior lubricity, good conductivity, and does not melt together with Ag. When a coating film in which C powder is dispersed in an Ag matrix is formed on a sliding surface, therefore, galling is inhibited and the contact resistance during sliding movement of the contact surfaces is maintained at a low level. Further, even when the contact surfaces are heated by large current, surface fusion or welding is inhibited, so that the sliding contact surface remains smooth and current conduction remains stable continuously.

Thus, in the present invention, the contact resistance during sliding movement of the mating surfaces is kept low to suppress heat generation due to conduction current and to reduce mechanical sliding abrasion. As a result, a sliding contact having large capacity for current conduction and a long life can be obtained. Further, heat generation is maintained at such a low level that the contact force can be reduced. Thus, the spring mechanism for applying the contact force and the drive mechanism for operating the contact may be of reduced capacity, making it possible to reduce the size of the overall equipment in which the invention is used.

The following examples of the composite material used in the practice of the invention will facilitate an understanding of the invention.

EXAMPLE 1

In the movable contactor portions 115 of the exemplary circuit breaker described, a coating film, having a thickness of 7 μm and made of composite of Ag and C in which C was dispersed in an Ag matrix in an amount of 6% by volume, was formed on each of the movable and fixed conductors 105 and 108 by the following electric plating method.

Figure 19:
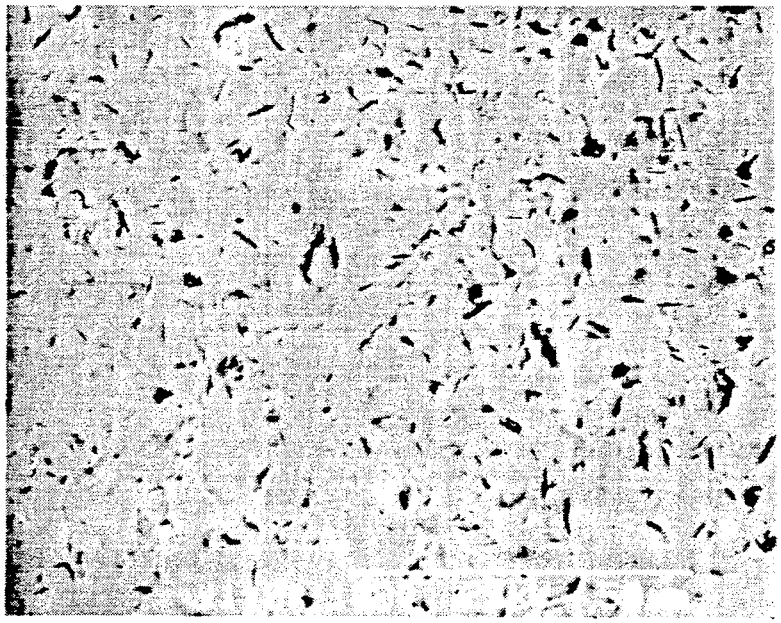
FIG. 19 is an electron microscopic photograph showing the metal construction of the sliding contact portion of FIG. 18.

FIG. 19 is an electron microscopic photograph (900 magnifications) showing the dispersed state of C in the plated coating film obtained in Example 1, black dots in the photograph being C.

A. Composition of Plating Liquid
- metal silver concentration:35 g/l
- potassium cyanide:110 g/l
- potassium hydroxide:8 g/l
- graphite powder:20 g/l
- the size of C particle:
- long diameter:0.5–2 μm
- short diameter:0.2–0.5 μm
- dispersant for dispersing graphite powder in plating liquid:200 ppm B. Plating conditions
- anode:silver plate
- bath temperature:20° C.
- current density:1A/dm$^2$
- agitation:yes

EXAMPLE 2

A coating film having a thickness of 7 μm and made of Ag and 30%C (volume percent) was formed on each of the movable and fixed conductors 105 and 108 in the same manner as in Example 1. The plating condition in this case was the same as that of Example 1 except that the bath temperature was 35° C. and the long and short diameters of C particles were 0.8–5 μm and 0.3 –1 μm respectively.

COMPARATIVE EXAMPLES

As comparative examples, prepared were two sliding contacts in which the movable and fixed conductors 105 and 108 were plated with Ag by 7 μm in the same manner (Comparative example 1), and in which grease was applied onto the movable and fixed conductors 105 and 108 (Comparative Example 2).

COMPARATIVE TEST RESULTS

The movable and fixed conductors 105 and 108 were incorporated into a circuit breaker, and a no-load switching test and a large current cut-off test were conducted. In the no-load switching test, pivotal reciprocation conductor 105 was repeated to effect sliding at the contact portions 115. In the large current cut-off test, the contact portions 115 were maintained in the current conduction state. Table 1 shows the results of the test.

As may be seen from Table 1, in the sliding contacts plated with the Ag-C composite material of the invention, the foundation copper was not exposed. The sliding contacts generally plated with Ag and the sliding contacts to which grease was applied onto the plating coating film were noticably worn under the same or less strenuous test conditions as shown in the table.

TABLE 1

| | surface coating | no load switching test | large current cut-off test |
|---|---|---|---|
| Embodiment 1 | Ag-6% C | no exposure of copper after 10,000 times switching | no exposure of copper in cutting off 30 KA current |
| Embodiment 2 | Ag-3% C | the same as above | the same as above |
| Comparative Example 1 | Ag | exposure of copper after 2,000 times switching | exposure of cupper in cutting off 20 KA current |
| Comparative Example 2 | Ag grease coating | exposure of copper after 10,000 times switching | exposure of cupper in cutting off 25 KA current |

Figure 20:
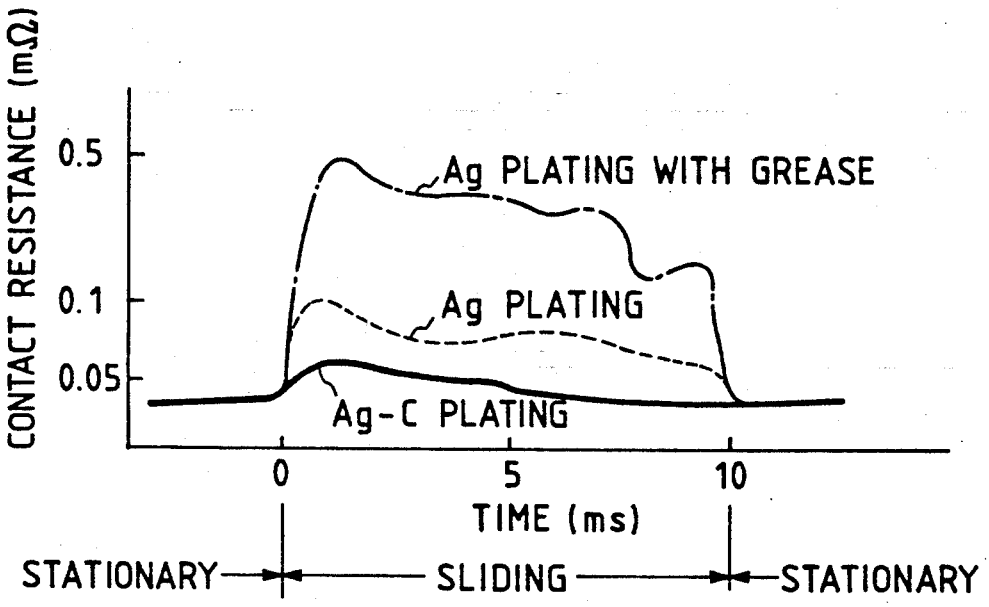
FIG. 20 is a diagram showing resistance measurements of sliding contact surfaces.

FIG. 20 shows measurement results of the contact resistance of the sliding contact portions 115 when the sliding contacts of Example 1 and Comparative Examples 1 and 2 were slid under a DC current load of 10A. Although there was only a small difference in the contact resistance in the stationary state among three sliding contacts, during sliding movement, the contact resistance of the sliding contact plated with a composition of Ag-6%C was the lowest and the fluctuation of the contact resistance was the smallest. Generally, the temperature of the electric contacting portion of a contact is proportional to the voltage, that is,—current x contact resistance—of the contractor portion. Therefore, the temperature in the current conduction state during sliding movement of the contacting surfaces is the lowest in the case of the sliding contact coated with the composition of Ag-6%C.

Although two examples have been described as to the sliding contact in a circuit breaker of the foregoing embodiment, the effects of the present invention depend on the property of C, and therefore the volume %C and the particle size of C are not limited to those mentioned above. Since the degree of galling in the sliding contact portion and the degree of fusion of the same are influenced also by the area and surface pressure of the contact portion, the volume %C and the particle size of C must be determined on the basis of all the factors. Although C has conductivity, the electric resistance thereof is hundreds or thousands times as high as that of Ag. Therefore, it is not desirable to increase unnecessarily the volume %C or to use C particles having a size which is so large as to pass through the plating thickness because heat generation in the sliding contact portion is increased.

Although the coating film is formed by electric plating in the foregoing embodiment, it is important that the coating film is made of a composite of Ag and C and, therefore, the coating film forming method is not limited to electric plating.

Since prevention of galling or prevention of welding is provided by the existence of C in the sliding contact surface, the same effects can be obtained also when a coating film of Ag-C is formed on only one of the movable and fixed conductors. In this case, although it is desirable that the non-coated member is plated with Ag, the current conduction characteristic can be obtained to a certain extent even where copper because C has an oxidation preventing capability. Further, it is not necessary that the coating film is formed on the whole surface of the conductors, but only that it be formed on the sliding contact surface regions.

Moreover, if hard fine particles such as Sic, WC, ZrB, $Al_2O_3$, $ZrO_2$, $Cr_2O_3$, $TiO_2$, $R_2O_3$, $ThO_2$, $Y_2O_3$, $MoO_3$, $W_2C$, TiC, $B_4C$, $CrB_2$, or the like, are dispersed in Ag-C as the third particles, the hardness of the whole coating film is increased, thereby to make it possible to obtain a long life contact surface which is less likely to be worn away.

The plating condition is such that a fundamental bath may be used with a range of plating liquid compositions in which the metal silver concentration is 2–100 g/l, the content of potassium cyanide is 2–250 g/l, and the content of potassium hydroxide is 0.5–15 g/l, and graphite powder can be used within the range of 1–550 g/l. The diameter of graphite may be 0.05–25 μm, preferably, 0.2–10 μm.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A movable electrical contactor having a surface thereof in slidable contact with a mating conductor, said surface being coated with a composite material in which particles of graphite (C) are dispersed in a matrix of silver (Ag), characterized in that the coating film is formed by electric plating using a plating liquid comprising:

metal silver in the range of 2–100 g/l in concentration, potassium cyanide in the range of 2–250 g/l, potassium hydroxide in the range of 0.5–15 g/l, graphite powder in the range of 1–55 g/l, and a dispersant for dispersing graphite powder into plating liquid in the range of 10–2000 ppm.

2. A movable electrical contactor according to claim 1, in which hard fine particles, which is selected from the group consisting essentially of SiC, WC, ZrB, $Al_2O_3$, $ZrO_2$, $Cr_2O_3$, $TiO_2$, $R_2O_3$, $ThO_2$, $Y_2O_3$, $MoO_3$, $W_2C$, TiC, $B_4C$, $CrB_2$, or the like, are dispersed in Ag-C as third particles.

* * * * *

UNITED STATES PATENT AND TRADEMARK OFFICE

CERTIFICATE OF CORRECTION

PATENT NO. : 5,199,553

DATED : April 06, 1993

INVENTOR(S) : Hisaji Shinohara et al.

It is certified that error appears in the above-indentified patent and that said Letters Patent is hereby corrected as shown below:

Claim 2, column 20, line 63, change "is" to --are--.

Claim 2, column 20, line 64, delete "Al-" and on line 65, before "$_2O_3$" insert --Al--.

Signed and Sealed this

Fifth Day of April, 1994

Bruce Lehman

*Attest:*

BRUCE LEHMAN

*Attesting Officer*

*Commissioner of Patents and Trademarks*